United States Patent [19]

Hilding

[11] 3,937,491

[45] Feb. 10, 1976

[54] NON-SKID RELEASABLE SHEET PAPER NOTE PAD

[76] Inventor: Anderson C. Hilding, 421 - 36th Ave. East, Duluth, Minn. 55807

[22] Filed: Dec. 12, 1974

[21] Appl. No.: 531,893

[52] U.S. Cl. ..... 281/15 B

[51] Int. Cl.[2] ..... B42D 1/00; B42D 5/00

[58] Field of Search ..... 281/1, 15 R, 15 A, 15 B, 281/20, 45–50; 248/188.2, 247, 250, 400, 506; 40/358; 282/8 R, 8 A, 8 C, 9 R, 9 A; 206/450

[56] References Cited

UNITED STATES PATENTS 2,079,257 5/1937 Kaiser ..... 281/15 B

*Primary Examiner*—Robert W. Michell
*Assistant Examiner*—V. Millin
*Attorney, Agent, or Firm*—Wicks & Nemer

[57] ABSTRACT

A non-skid releasable sheet paper note pad including a sheaf of sheets of paper having a flat resilient member with a relatively high coefficient of friction secured to the bottom of the sheaf of paper. The flat resilient member has supports connected to the underside thereof adapted to support the pad on a surface for sliding movement thereon with the resilient member free of the surface, the support member having a low coefficient of friction relative to the resilient member. The resilient member is adapted to contact a surface when pressure of a writing instrument is made upon the pad thereby preventing the pad from slipping when written upon on a supporting surface.

2 Claims, 4 Drawing Figures

NON-SKID RELEASABLE SHEET PAPER NOTE PAD

SUMMARY

The invention relates to an improvement in writing or note pads generally including a sheaf of paper mounted on a flat backing member such as cardboard. When it is attempted to write on the top sheet of the pad placed on a supporting surface, the pad slides on the surface in the direction of the force of the writing instrument upon the pad unless, of course, the pad is held by the writer's other hand or the pad is in abutment with a stationary object.

To solve the above problem and provide a pad which does not slide across a surface when written upon, a pad is provided which has on the bottom thereof supports which have a low coefficient of friction to allow the pad to be easily slid across a surface. The pad further includes a resilient member having a high coefficient of friction relative to the support and which is interposed between the support and the paper and which is caused to contact the surface as a result of pressure of a writing instrument upon the pad whereby the pad does not slip upon a supporting surface when written upon. With no pressure upon the pad the same may be easily slid about a surface upon the supports.

In the drawings forming part of this application:

Figure 1:
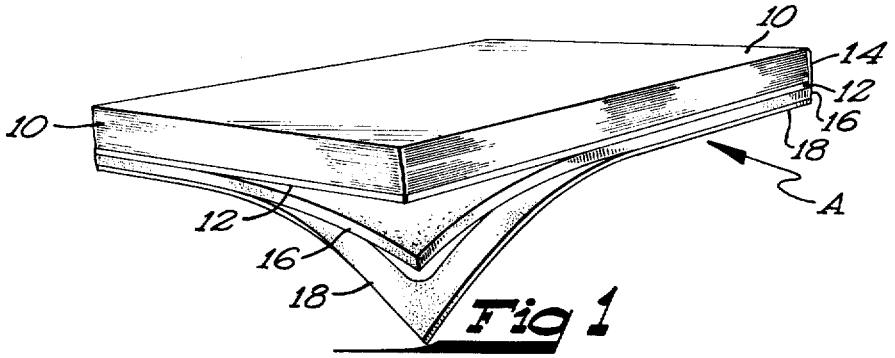
FIG. 1 is a perspective view of a non-skid releasable note pad embodying the invention with portions thereof separated one from the other at the lower corner of the pad.
Figure 2:
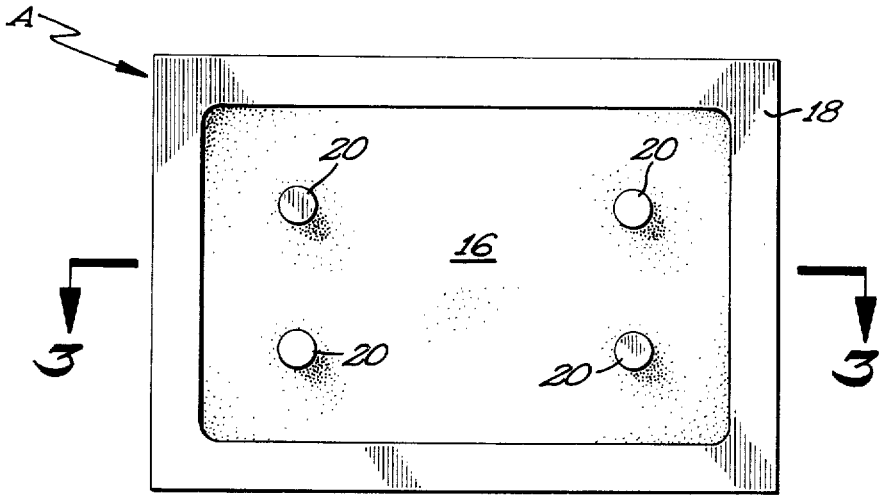
FIG. 2 is a bottom plan view of the pad.
Figure 3:
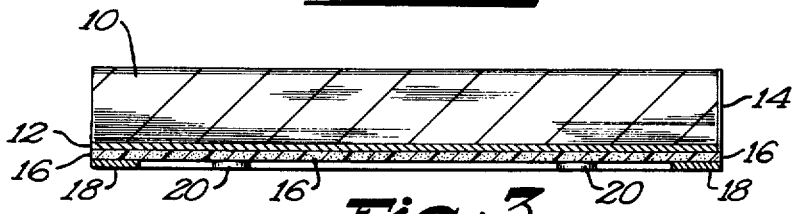
FIG. 3 is a sectional view on the line 3—3 of FIG. 2.
Figure 4:
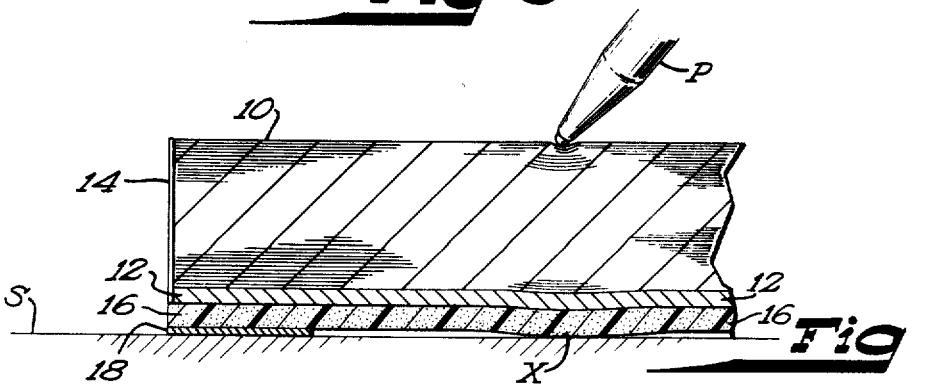
FIG. 4 is an enlarged sectional view of a portion of the pad with a marking device shown in writing position on the pad whereby the non-skid feature is in play.

Referring to the drawings in detail, the non-skid releasable note pad A includes the conventional sheaf of sheets of paper 10 and the flexible cardboard base 12 glued together across the end edges thereof as at 14. Further provided is the sheet of a substance in the form of a resilient deformable material 16 having a high coefficient of friction such as sponge rubber, "styrofoam" or the like which is attached to the bottom surface of the base 12 by cement or other suitable means.

Further provided is the pad support member 18 which is formed of a narrow strip of relatively thin, slippery material having a low coefficient of friction relative to that of the sheet 16. "Mylar," cellulose film or the like may be used. The support 18 is formed about the periphery of the sheet member 16 to form a marginal support for the pad which provides a maximum of area of the member 16 not in the marginal areas. The member 18 is secured to the sheet 16 by glue or the like. Further included are the spaced supports 20 which are of the same material as member 18 and the same are secured to the bottom of the resilient material 16 by glue or other suitable means.

The support member 18 and the spaced supports 20 allow the pad to be slid across the surface of a desk or the like without the sheet 16 touching the surface upon which the pad is positioned. The support member 18 may be formed of a different configuration but which is preferably positioned adjacent the outermost edge of the sheet material 16. The supports 20 may be of different shapes and placement upon the number 16.

When pad A is written upon on a firm supporting surface such as S with a writing instrument such a P, the pressure of the writing instrument causes the sheet 16 to be depressed slightly but enough to contact the surface as at "X" and prevent the pad from slipping on the surfaces of the members 18 and 20 as the writing instrument is caused to write across the pad.

I claim:

1. A non-skid releasable paper note pad comprising in combination:

a. a sheaf of sheets of paper for writing thereupon, b. a flat deformable member secured to the bottom of the sheaf of the paper, and having a relatively high coefficient of friction relative to c. spaced support means of equal thickness carried by said flat deformable member on the under surface adjacent the ends and sides of the deformable member and extending therefrom to thereby support the pad for sliding movement upon the support means upon a supporting surface with the flat deformable member free of the supporting surface, said flat member deformed and in contact with a surface upon pressure of a writing instrument on the sheaf of paper thereby preventing sliding movement of the pad upon a supporting surface during the act of writing thereon.

2. The Device of claim 1 in which said support means is substantially marginal of the flat member.

* * * * *